United States Patent [19]

Middleton

[11] Patent Number: 4,486,161

[45] Date of Patent: Dec. 4, 1984

[54] MELT-BLOWING DIE TIP WITH INTEGRAL TIE BARS

[75] Inventor: David L. Middleton, Roswell, Ga.

[73] Assignee: Kimberly-Clark Corporation, Neenah, Wis.

[21] Appl. No.: 494,073

[22] Filed: May 12, 1983

[51] Int. Cl.[3] ..... B29F 3/04

[52] U.S. Cl. ..... 425/7; 264/12; 425/80.1; 425/192 S

[58] Field of Search ..... 425/381, 191, 381.2, 425/192 R, 192 S, 7, 80.1; 264/12

[56] References Cited

U.S. PATENT DOCUMENTS

| | | | |
|---|---|---|---|
| 3,461,500 | 8/1969 | Haley | 425/192 |
| 3,488,669 | 1/1910 | Goodram et al. | 425/192 |
| 3,507,939 | 4/1970 | Williams et al. | 425/192 |
| 3,525,785 | 8/1970 | Fairbanks | 425/381 |
| 3,565,985 | 2/1971 | Schrenk et al. | 425/382 |
| 3,606,636 | 9/1971 | Glass et al. | 425/381 |
| 3,702,226 | 9/1972 | Kimma | 425/382 |
| 3,825,379 | 7/1974 | Lohkamp et al. | 425/72 |
| 3,832,120 | 8/1974 | Shaffer | 425/381 |
| 3,942,723 | 3/1976 | Langdon | 239/135 |
| 3,978,185 | 8/1976 | Buntin et al. | 264/93 |
| 4,015,926 | 4/1977 | Nehmey | 425/382 |
| 4,021,281 | 5/1977 | Pall | 156/167 |
| 4,048,364 | 9/1977 | Harding et al. | 428/113 |
| 4,248,579 | 2/1981 | Maejima | 425/381 |
| 4,295,809 | 10/1981 | Mikami et al. | 264/12 |

FOREIGN PATENT DOCUMENTS

| | | | |
|---|---|---|---|
| 2550463 | 6/1976 | Fed. Rep. of Germany | 264/12 |
| 48-20625 | 6/1973 | Japan | 425/381 |

OTHER PUBLICATIONS

United States Department of Commerce "Manufacture of Superfine Organic Fibers".

U.S. Naval Research Laboratory, "An Improved Device for the Formation of Superfine, Thermoplastic Fibers".

*Primary Examiner*—Jay H. Woo

*Assistant Examiner*—James C. Housel

*Attorney, Agent, or Firm*—William D. Herrick; R. Jonathan Peters; Howard Olevsky

[57] ABSTRACT

In a melt blowing die tip having a generally triangular nose portion with a knife-edge forming the extremity of the die tip, a channel extending lengthwise of the die tip, a row of small openings extending from the channel to the knife-edge extremity of the die tips, and a plurality of tie bars of generally elliptical cross section integral with the die tip and bridging the channel to strengthen the die tip to withstand the internal, outwardly directed pressure exerted by molten polymer forced into the channel from the die body and flowing to be extruded through the die openings.

5 Claims, 6 Drawing Figures

MELT-BLOWING DIE TIP WITH INTEGRAL TIE BARS

TECHNICAL FIELD

The present invention relates to melt blowing dies and, more particularly, to an improved construction for die tips for such dies.

BACKGROUND ART

One type of construction for melt-blowing dies employs a die tip having a generally triangular nose portion mounted on a die body. In such dies, the die body is provided with a distributor cavity for distributing the flow of molten polymer the full length of the die while the die tip is provided with a row of small diameter openings which extend to the extremity of the die tip through which the molten polymer is extruded directly into two converging, high velocity streams of heated gas. The fibers formed from the molten material are attenuated and separated into discrete lengths by the gas streams.

In such dies, the distributor cavity connects with a channel in the mounting face of the die tip which leads to the die openings. The present invention is concerned with one-piece die tip constructions machined from a solid block of metal. In production dies, the length of the channel in the die tip may be ten to twelve feet while the width of the channel is usually less than one-half inch. The openings through which molten material is extruded under high pressure are extremely small, on the order of 0.010 inches to 0.25 inches in diameter, and lie in a row. Typically, they may be spaced about thirty to an inch and extend the full length of the die tip through a section of metal between the bottom of the channel and the extremity of the die tip less than one-eighth of an inch in thickness. This leaves very little metal between the openings to provide mechanical strength to hold the opposite halves of the die tip together.

Mechanical strength is required to withstand the internal, outwardly directed pressure exerted by molten polymer forced into the channel from the die body and flowing to be extruded through the die openings. Heretofore, in order to strengthen the die tip, machine screws have been inserted spanning the channel and tubular spacers have been utilized in combination with the screws to hold the halves of the die tips together. Difficulties have been found with such methods of strengthening. For example, under operating conditions, the spacers can rotate, so that spacers having special shapes to streamline polymer flow cannot be held in position and the advantage of special streamlined shapes is lost. Another difficulty has been found in that the spacers, where they abut the surface of the channel at each end, form minute cavities at those junctures wherein particles of polymer can accumulate and deteriorate. Furthermore, cleaning and washing of the die tip can cause corrosion of the screws due to leakage of the liquid through the junctures between the spacers and the channels, requiring complete disassembly of the tip to avoid such corrosion.

DISCLOSURE OF INVENTION

The principal object of this invention is to tie the halves of a die tip together with material integral with that from which the die tip is made to strengthen the die tip in order to withstand the internal, outwardly directed pressure exerted by molten polymer forced through the die tip.

Another object is to provide preferentially spaced and shaped bars to tie the halves of the die tips together.

BRIEF DESCRIPTION OF THE DRAWINGS

Further objects will appear from the following description taken in conjunction with the accompanying drawings, in which.

BEST MODE FOR CARRYING OUT THE INVENTION

Figure 1:
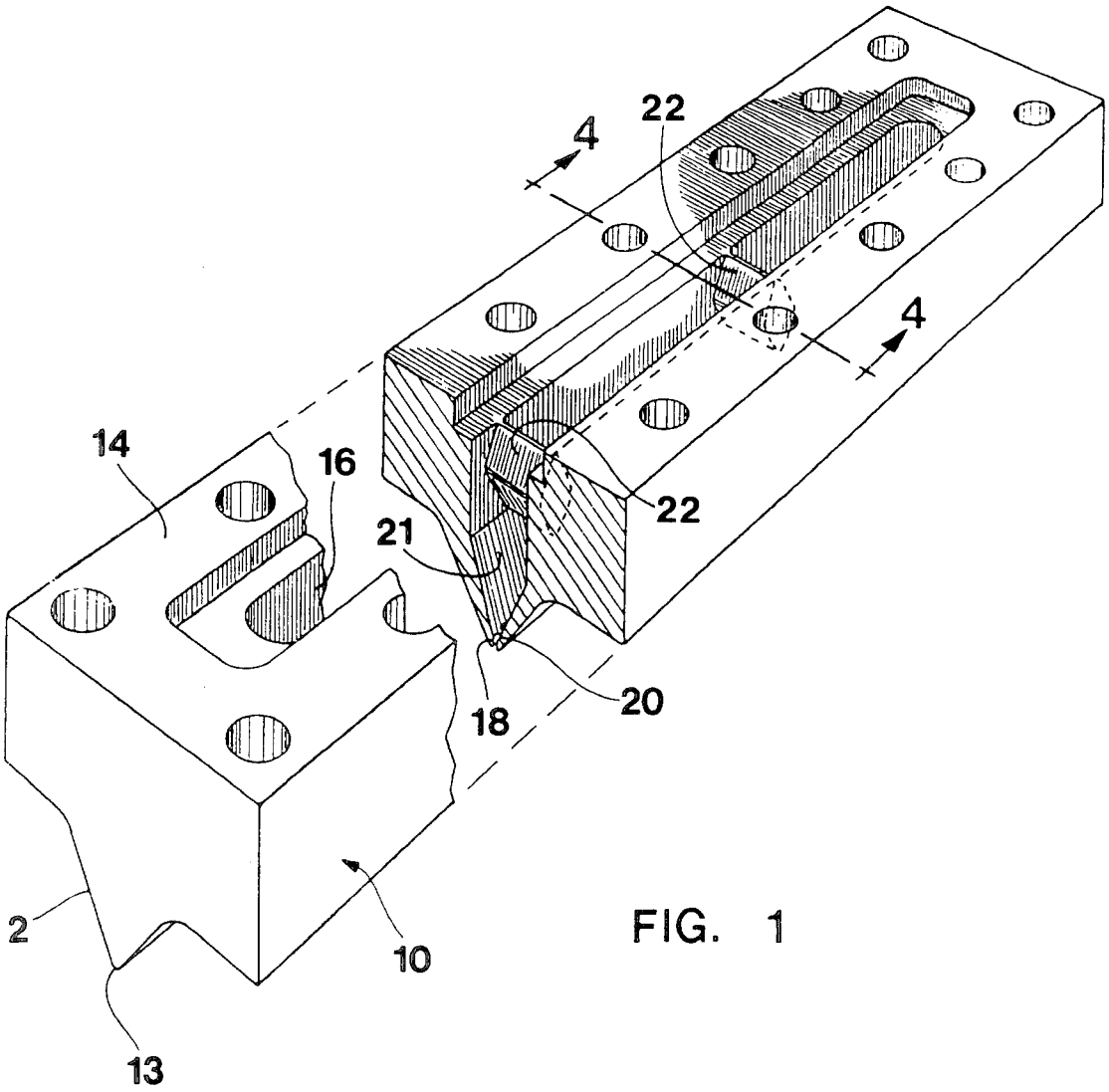
FIG. 1 is a perspective view of a die tip with integral tie bars constructed in accordance with this invention.
Figure 3:
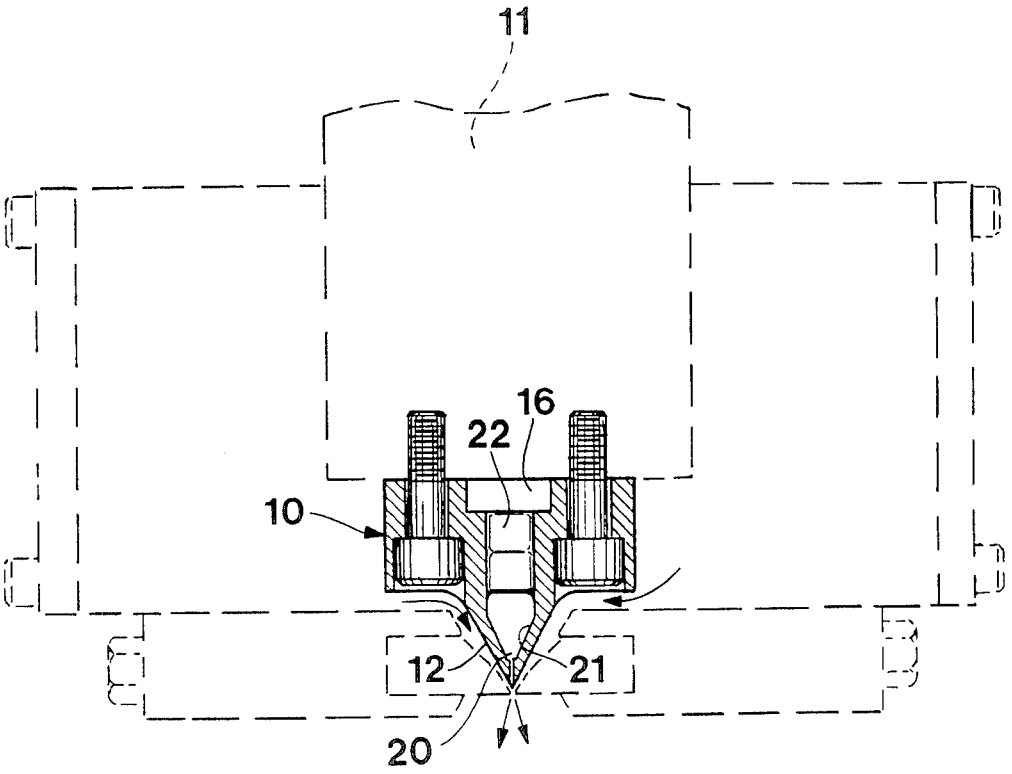
FIG. 3 is a sectional view of a die tip constructed in accordance with this invention shown assembled on a die body illustrated in phantom lines.
Figure 4:
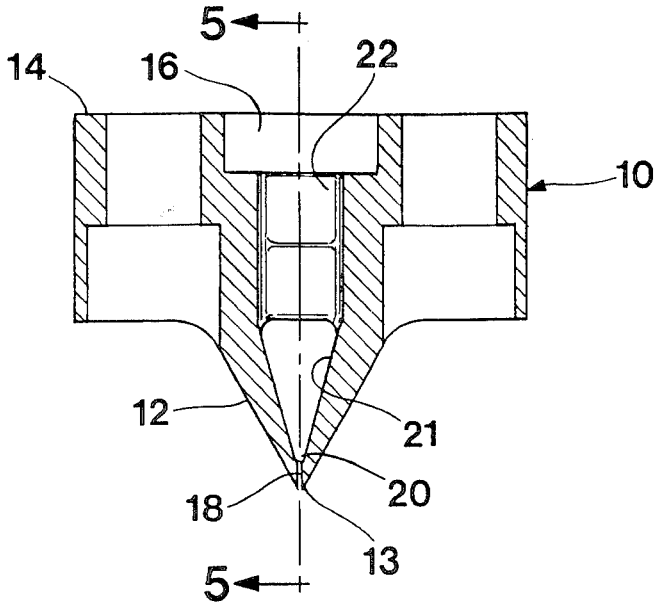
FIG. 4 is a cross sectional view of the die tip shown in FIG. 1 taken substantially in the plane of lines 4—4 of FIG. 1.

Referring to FIG. 1, there is illustrated a die tip 10 for a melt blowing die, adapted to be mounted on a die body 11 (FIG. 3). The die tip 10 has a nose portion 12 of generally triangular cross section with a knife-edge forming the extremity 13 of the die tip opposite the mounting face 14. A channel 16 extends inwardly from the face 14 and lengthwise of the die tip 10, while a row of extremely small diameter die openings 18, on the order of 0.010 inches to 0.025 inches in diameter, extend from the bottom 20 of a tapered section 21 of the channel 16 to the extremity 13 of the die tip 10. When the die tip 10 is mounted on a die body, as illustrated in FIG. 3, a cavity (not shown) in the mating face of the die body 11 which communicates with the channel 16 distributes the flow of molten polymer received from an extruder the full length of the die tip 10 and conveys the molten polymer into the channel 16 and through the die openings 18 from which the molten polymer is extruded directly into two converging high velocity streams of heated gas, shown generally by the arrows in FIG. 3. The fibers formed from the molten polymer are attenuated and separated into small diameter "microfibers" of discrete lengths by the high velocity gas streams.

Preferably the die tip 10 is machined from a solid block of metal, the channel 16 and die openings 18 being cut by machining processes, such as electric-discharge machining known as EDM. According to this invention, the channel 16 is machined so as to leave a plurality of tie bars 22 integral with the die tip 10 and bridging the channel 16 to strengthen the die tip 10 to withstand the internal, outwardly directed pressure exerted by molten polymer forced into the channel 16 from the die body and flowing to the die openings 18.

Figure 2:
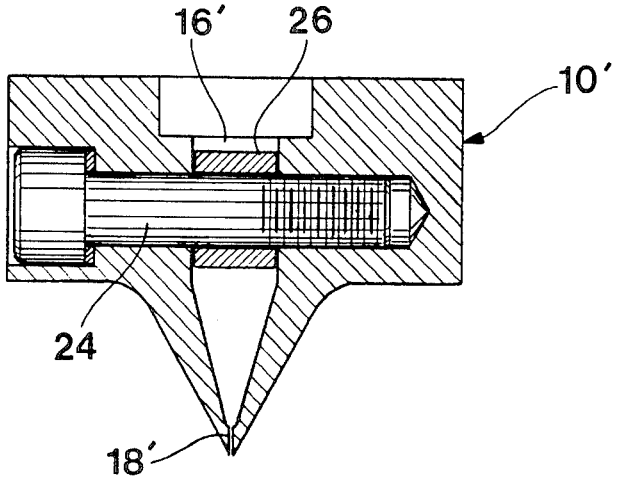
FIG. 2 (PRIOR ART)
FIG. 2 is a cross section of a prior art die tip construction with machine screws and spacers to tie the halves of a die tip together.

Heretofore, in prior art die tip constructions, an exemplary one being illustrated in FIG. 2, the opposite halves of the die tip 10' are held together by means such as machine screws 24, which extend across the channel 16'. Spacers 26, through which the machine screws extend, are included as part of the strengthening assembly and the spacers 26 may have a tear drop construction in order to streamline the flow of polymer past the spacers through the channel 16' to the die openings 18'. As previously noted, such spacers can rotate in practice so that streamlined shapes cannot be held in position and the advantage of such special shapes is lost.

Figure 5:
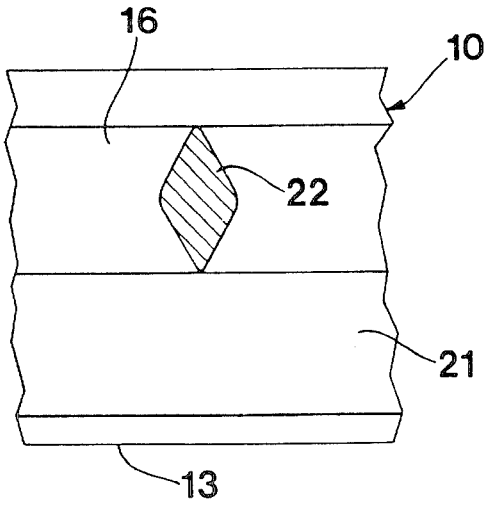
FIG. 5 is a fragmentary cross sectional view taken substantially in the plane of lines 5—5 of FIG. 4 and illustrating a single tie bar constructed according to the invention.

In accordance with this invention, it is preferred to utilize tie bars 22 instead of machine screws and spacers, as known heretofore, and to shape the tie bars 22 in such a manner as to minimize disturbance to the polymer flow. One preferred shape, as illustrated in FIG. 1 and FIG. 5, is a generally elliptical cross section with knife-edge leading and trailing edges. By "generally elliptical" is meant to include shapes, such as shown in FIG. 5, which are symmetrical and thicker in the waist portion, coming to a knife-edge or pointed edge at one or both ends.

Figure 6:
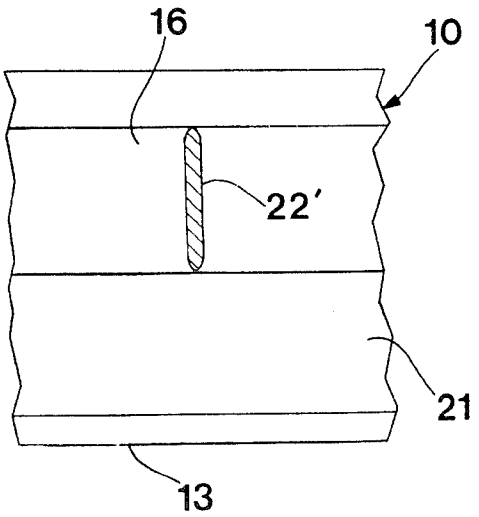
FIG. 6 is a cross sectional view similar to FIG. 5 illustrating an alternative tie bar shape.

The most preferred construction is illustrated in FIG. 6, in which the tie bar 22' is shaped as a thin web spanning the channel 16 of substantially uniform thickness throughout the extent of the tie bar except at the leading and trailing ends, which come to a knife-edge. The term "generally elliptical" is also intended to include such configurations.

The locations and dimensions of the tie bars 22, 22' (FIG. 5, 6) are preferably established to add sufficient strength to withstand the pressure exerted by the molten polymer which tends to peel the opposite halves of the triangular nose portion 12 of the die tip 10 outwardly and cause the die tip to rupture along the line of the row of die openings 18. In addition, the tie bars 22, 22' are preferably located and dimensioned to minimize disruption in polymer flow by spacing the inward most edge of the tie bars from the entrance to the die openings 18 so that the molten polymer blends completely after passing the opposite sides of each tie bar and by having the tie bars 22, 22' as thin as practical so that the spreading action is minimized.

The tapered section 21 of the channel 16 defines the area against which the pressure of the molten polymer acts and tends to rupture the die tip 10. The cross sectional area of the metal remaining between the die openings 18 provides the strength at the extremity 13 of the die tip 10. According to this invention, the tie bars 22, 22' are located within the channel 16 adjacent the wide entrance to the tapered section 21 of the channel 16. In this location, space is provided within the tapered section 21 for the polymer to blend after flowing around the tie bars 22. 22'. Furthermore, the tie bars 22, 22' are sized to have substantially equal strength to that provided at the extremity of the die tip. Thus, according to this invention, the cross sectional area of the tie bars is made approximately equal (by no more or less than about twenty percent) to the cross sectional area of the metal remaining between the die openings 18.

In an exemplary construction, having die openings of 0.0140 inches diameter extending axially through the end wall of about 0.125 inches in thickness and having thirty such openings per inch, for every inch of die length, the remaining metal between die openings is approximately 0.07 square inches. By providing a tie bar 1.75 by 0.125 inches in cross section every four inches along the channel 16, the cross sectional area of metal provided by the tie bars is about 0.055 square inches per inch, which is approximately twenty percent less area than that provided between the die openings. Such a construction is within the range of sizes most preferred for tie bars constructed according to this invention.

I claim:

1. In a melt blowing die tip having a generally triangular nose portion with a knife-edge forming the extremity of the die tip:

a channel extending lengthwise of the die tip;

a row of small openings extending from said channel to the knife-edge extremity of the die tip; and a plurality off tie bars integral with the die tip and bridging said channel, said tie bars being integral with opposite sides of said channel in said die tip and bridging said channel to strengthen the die tip to withstand the internal outwardly directed pressure exerted by the molten polymer forced into said channel and flowing to be extruded through the die openings.

2. A die tip according to claim 1 in which each of said tie bars is spaced from the entrances to said openings to permit polymer flowing past said tie bars to blend before entering said openings.

3. A die tip according to claim 1 in which said tie bars are formed as a thin web in cross section having knife-edge leading and trailing edges.

4. A die tip according to claim 1 in which said tie bars have a generally elliptical cross-section.

5. A die tip according to claim 1 in which said tie bars have a cross sectional area substantially equal to the cross sectional area of metal remaining between said die openings.

* * * * *